US009617992B2

(12) United States Patent
Weigl et al.

(10) Patent No.: US 9,617,992 B2
(45) Date of Patent: Apr. 11, 2017

(54) ROTARY PISTON PUMP WITH OPTIMISED INLETS AND OUTLETS

(71) Applicant: NETZSCH Pumpen & Systeme GmbH, Selb (DE)

(72) Inventors: Stefan Weigl, Muehldorf am Inn (DE); Reinhard Denk, Muehldorf (DE); Hisham Kamal, Waldkraiburg (DE); Josef Strassl, Straubing (DE); Robert Kurz, Aschheim (DE); Bernhard Murrenhoff, Buchbach (DE); Thomas Boehme, Waldkraiburg (DE); Gunther Herr, Haarth (DE); Franz Kneidl, Waldkraiburg (DE); Mikael Tekneyan, Waldkraiburg (DE); Matthias Gradl, Sesslach (DE); Erwin Weber, Ampfing (DE); Roger Willis, Mettenheim (DE); Stefan Kern, Haag (DE); Johann Kreidl, Waldkraiburg (DE); Marcel Verhoeven, Hailsham East Sussex (GB)

(73) Assignee: NETZSCH Pumpen & Systeme GmbH, Selb (DE)

( * ) Notice: Subject to any disclaimer, the term of this patent is extended or adjusted under 35 U.S.C. 154(b) by 145 days.

(21) Appl. No.: 14/531,501

(22) Filed: Nov. 3, 2014

(65) Prior Publication Data

US 2015/0050174 A1 Feb. 19, 2015

Related U.S. Application Data

(63) Continuation of application No. PCT/DE2013/100127, filed on Apr. 9, 2013.

(30) Foreign Application Priority Data

May 2, 2012 (DE) ..... 10 2012 008 527

(51) Int. Cl.
*F03C 2/00* (2006.01)
*F03C 4/00* (2006.01)
(Continued)

(52) U.S. Cl.
CPC ..... *F04C 2/18* (2013.01); *F04C 2/086* (2013.01); *F04C 2/126* (2013.01); *F04C 13/00* (2013.01);
(Continued)

(58) Field of Classification Search
CPC .. F04C 2/086; F04C 2/126; F04C 2/18; F04C 13/00; F04C 15/06; F04C 15/0049; F04C 13/001; F01C 1/3441
(Continued)

(56) References Cited

U.S. PATENT DOCUMENTS 4,017,222 A 4/1977 Ueno et al.
2012/0207638 A1 8/2012 Krampe

FOREIGN PATENT DOCUMENTS

DE 94751 C 5/1896
DE 3427282 A1 1/1986
(Continued)

OTHER PUBLICATIONS

International Search Report Application No. PCT/DE2013/100127 Completed: Oct. 7, 2013; Mailing Date: Oct. 14, 2013 3 pages.

*Primary Examiner* — Theresa Trieu
(74) *Attorney, Agent, or Firm* — Whitmyer IP Group LLC

(57) ABSTRACT

A rotary piston pump for the delivery of liquids and for the delivery of liquids containing solids. The rotary piston pump includes a pump housing which is provided with an inlet and an outlet. The pump housing includes a lining. Disposed in the pump housing, or inside the lining, are at least two counter-rotating rotary pistons, which form pump spaces during their rotation. During the rotational movement, the
(Continued)

rotary pistons are sealed against one another, against the pump housing and against the lining. Disposed in the pump housing and/or in the lining, in the spatial vicinity of the inlet and/or the outlet, are means with which the pulsation can be reduced or even completely prevented.

14 Claims, 5 Drawing Sheets

(51) Int. Cl.

| | |
|---|---|
| ***F04C 2/00*** | (2006.01) |
| ***F04C 2/18*** | (2006.01) |
| ***F04C 15/06*** | (2006.01) |
| ***F04C 2/08*** | (2006.01) |
| ***F04C 2/12*** | (2006.01) |
| ***F04C 15/00*** | (2006.01) |
| *F04C 13/00* | (2006.01) |

(52) U.S. Cl.
CPC ..... *F04C 15/0049* (2013.01); *F04C 15/06* (2013.01); *F04C 13/001* (2013.01)

(58) Field of Classification Search
USPC .... 418/206.1–206.9, 189–190, 112, 180, 15, 418/1
See application file for complete search history.

(56) References Cited

FOREIGN PATENT DOCUMENTS

| | | | |
|---|---|---|---|
| DE | 202006020113 | U1 | 11/2007 |
| DE | 102006041633 | A1 | 3/2008 |
| DE | 202009012158 | U1 | 2/2011 |
| FR | 2292881 | A1 | 6/1976 |
| GB | 2101218 | A | 1/1983 |
| WO | 9314314 | A1 | 7/1993 |

ROTARY PISTON PUMP WITH OPTIMISED INLETS AND OUTLETS

FIELD OF THE INVENTION

The present invention relates to a rotary piston pump for the delivery of liquids and for the delivery of liquids containing solids. The rotary piston pump comprises a pump housing, which is provided with an inlet and an outlet. The pump housing comprises a lining. Disposed in the pump housing, or inside the lining, are at least two counter-rotating rotary pistons, which form pump spaces during their rotation. During the rotational movement, the rotary pistons are sealed against one another, against the pump housing and against the lining.

BACKGROUND OF THE INVENTION

German patent application DE 10 2006 041 633 A1 discloses a pump with a housing formed from two intersecting cylindrical sections, wherein inlet and outlet openings are provided at mutually opposite sides and there is disposed, in each cylindrical section, a rotor rotatable about the central longitudinal axis thereof. The larger transverse axes of the rotors lie each time approximately normal to one another in at least one movement phase, wherein the rotors roll in a sealing manner against one another and against the housing interior wall, and the surface lines of each rotor proceeding from the point of intersection of the large transverse axes run in mutually opposite directions inclined to the respective central longitudinal axis. Each rotor comprises two approximately lobe-shaped sections, which are connected to one another at their narrower end by a constricted zone. If the large transverse axes of the two rotors lie normal to one another, the lobe-shaped shaped section of the one rotor engages in the constricted zone of the other rotor and the two rotors roll against another in a sealing manner. In each phase of the rotational movement, the two rotors form a uniformly increasing intake volume in front of the inlet opening and a uniformly diminishing outlet volume in front of the outlet opening. In order to improve the pump output and to increase the stability, provision is made such that the surface lines acting as sealing lines are constituted sinusoidal.

German utility model DE 20 2009 012 158 U1 discloses a rotary piston pump for delivering a fluid medium containing solids. The pump is provided with two rotary pistons with rotary piston vanes engaging into one another and with, in each case, a rotational axis and an outer circumference, wherein the rotational axes of the two rotary pistons are disposed spaced apart from one another and parallel to one another and the outer circumferences of the two rotary pistons partially intersect, and a housing with an inlet opening and an outlet opening as well as an inner wall and an outer wall, wherein the inner wall of the housing in each case encloses a section of the outer circumferences of the rotary pistons and wherein the rotary piston pump is constituted so as to deliver the medium in a delivery direction from the inlet opening to the outlet opening.

German utility model DE 20 2006 020 113 U1 discloses a rotary piston pump for the delivery of fluids containing solids. The problem underlying the utility model is to pump fluids containing solids in such a way that damage in the pump, in particular to the rotary pistons, is prevented. This problem is solved by at least one specially constituted ramp by means of which the inlet is optimised. This optimisation ensures that solids are conveyed at a specific point into the pump chamber of the rotary piston pump. Furthermore, a reduction in cavitation is achieved by the special design of the ramps in the inlet region and outlet region of the rotary piston pump. In order to achieve the reduction in cavitation, an increase in the so-called housing angle is absolutely essential. It is however sufficient here for only the lower housing half angle to have an angle of >90°.

German patent specification DE 94 751 A shows a positive displacement blower, in which two counter-rotating pistons are moved, with which air is compressed and fed to an outlet. The blower is provided with two special single-tooth rollers C, which each co-operate with a delivery piston in such a way that each vane of the delivery piston is allowed to pass through with a tight shut-off by roller C, as a result of which roller C rolls into the following gap and compresses the air until the vane frees the outlet to the pressure chamber.

The problem underlying the invention is to provide a rotary piston pump with which a delivery can take place as far as possible without pulsation.

SUMMARY OF THE INVENTION

This problem is solved by a rotary piston pump including a pump housing with an inlet and an outlet. The pump housing includes a lining. Disposed in the pump housing or inside the lining are at least two counter-rotating rotary pistons which form pump spaces during their rotation. During the rotational movement, the rotary pistons are sealed against one another, against the pump housing and against the lining. Disposed in the pump housing and/or in the lining, in the spatial vicinity of the inlet and/or the outlet, are recesses with which the pulsation can be reduced or even completely prevented. Further advantageous embodiments can be derived from other disclosure herein.

A rotary piston pump for the delivery of fluids and for the delivery of fluids containing solids is disclosed. The rotary piston pump comprises a pump housing, which is provided with an inlet and an outlet. The pump housing comprises a lining. Disposed in the pump housing, or inside the lining, are at least two counter-rotating rotary pistons which form pump spaces during their rotation. During the rotational movement, the rotary pistons are sealed against one another, against the pump housing and against the lining. In each pump space, at least two recesses are disposed in the pump housing and/or in the lining. The recesses are disposed in the spatial vicinity of the inlet and/or the outlet. In the region of the inlet and in the region of the outlet, the pump housing and/or the lining can comprise reinforcements which lead to a reduction in cross-section. The reinforcements are designed at an angle of 20 to 160 degrees, preferably at an angle of 45 to 135 degrees. The inlet and the outlet widen from the reinforcements to their ends. The reinforcements preferably comprise a wrap angle of more than 180 degrees.

In a particular embodiment, four recesses are disposed in each pump space, wherein the recesses are always disposed in pairs. In a further embodiment, six recesses are provided in each pump space, wherein the recesses are then disposed in each case as a trio. For the person skilled in the art, it emerges from the above statements that they do not represent a conclusive limitation of the invention. It is possible for a plurality of recesses to be disposed in the pump spaces. Furthermore, it is conceivable to dispose a different number of recesses in the two pump spaces. By pump space, the average person skilled in the art denotes the space that is formed by the rotation of the rotary pistons in the rotary piston pump. This pump space, or these pump spaces, are located between the rotary pistons and the pump housing.

By means of the opening and closing of the recesses by the rotary pistons, the pulsation of the rotary piston pump can be prevented. Furthermore, by means of the opening and closing of the recesses, the pressure conditions in the pump spaces and in the inlet and/or in the outlet region can be changed. As a result of these pressure changes, the impacts in the inlet and/or in the outlet occurring due to the pulsation are reduced or completely prevented.

The widening at the ends of the inlet and the outlet enables an optimised flow of the delivery medium, wherein the optimised flow, in combination with the recesses, brings about an additional reduction in pulsation. The combination of recesses and reinforcement is configured in such a way that an optimised flow results during the operation of the rotary piston pump, wherein energy losses during delivery and dead spaces inside the rotary piston pump can be almost completely prevented.

The distance of the recesses from the inlet and/or from the outlet amounts to twice up to five times the cross-section of the recesses. The recesses can have different cross-sections. There can be a spacing between the recesses. The depth of the recesses amounts to at least ten to thirty percent of the wall thickness of the lining. The recesses can have different depths. Moreover, the recesses can have different cross-sections and depths in the inlet region and outlet region and in a multiple arrangement. For the person skilled in the art, it is clear that the previously stated comments do not represents a conclusive restriction of the invention. On the contrary, they refer to preferred embodiments. Through the different number and configurations of the recesses, it is possible to change in a variable manner or to prevent the pressure characteristics in the pump and therefore the flows and the pulsation.

Examples of embodiment of the invention and its advantages will be described below in greater detail with the aid of the appended figures. The size ratios of the individual elements with respect to one another in the figures do not always correspond to the actual size ratios, since some forms are represented simplified and other forms enlarged in relation to other elements for the sake of better clarity.

DETAILED DESCRIPTION OF THE INVENTION

Figure 1:
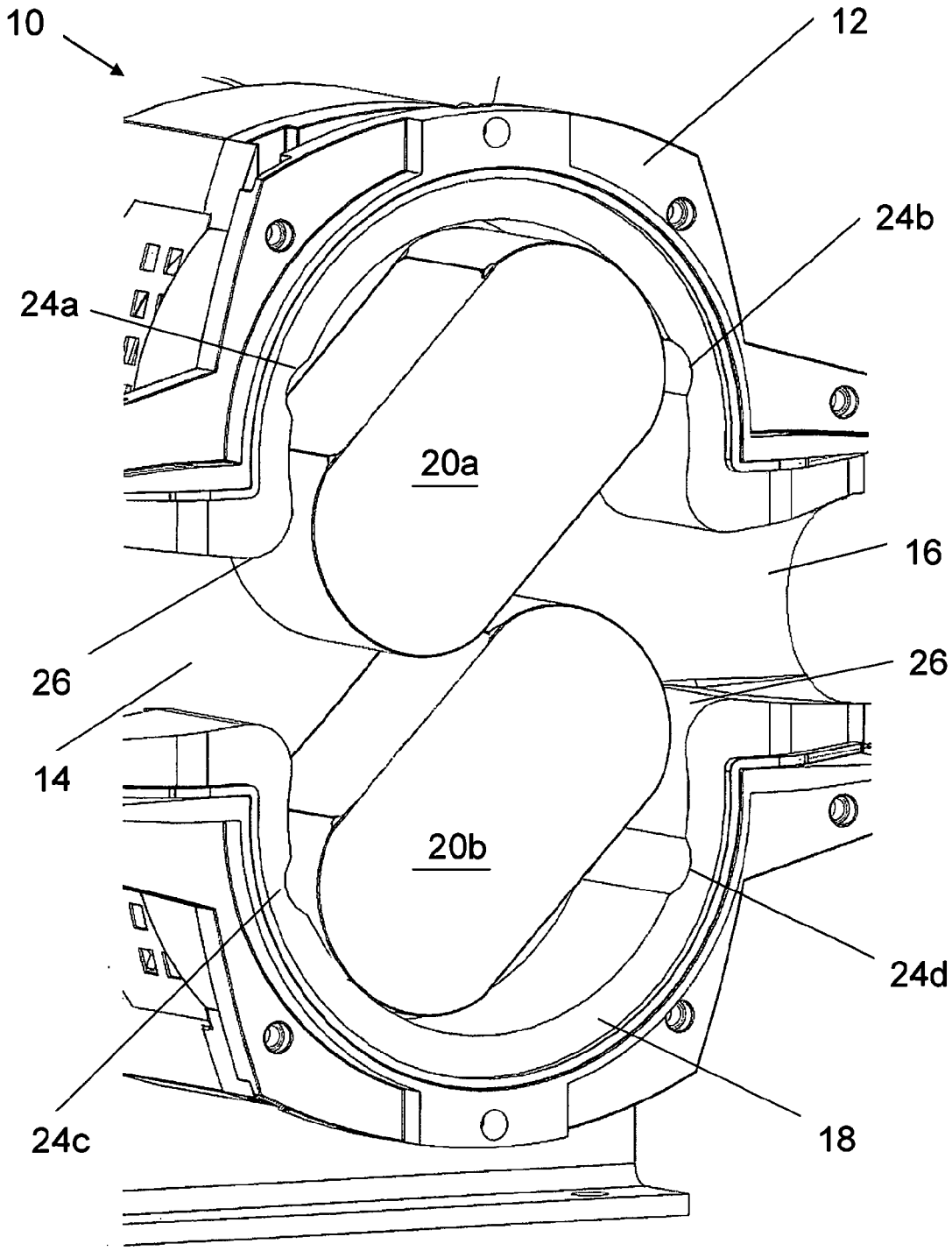
FIG. 1 shows a rotary piston pump according to the invention with opened pump housing.

FIG. 1 shows a rotary piston pump 10 according to the invention with opened pump housing 12. Rotary piston pump 10 comprises a pump housing 12 which is provided with an inlet 14 and an outlet 16. A lining 18 is introduced into pump housing 12. Lining 18 is provided with recesses 24*a*, 24*b*, 24*c* and 24*d*. The depth of the recesses 24*a*, 24*b*, 24*c* and 24*d* amounts to at least ten to thirty percent of the wall thickness of the lining 18 in areas of the lining 18 without recesses 24*a*, 24*b*, 24*c* and 24*d* hereinafter "thickness $T_1$" That is, the wall thickness of the lining 18 in areas of the lining with recesses 24*a*. 24*b*, 24*c* and 24*d* (hereinafter "thickness $T_2$") is at least ten to thirty percent less than thickness $T_1$. Furthermore, lining 18 comprises reinforcements 26 in the region of inlet 14 and outlet 16. Disposed in the interior of pump housing 12 are rotary pistons 20*a* and 20*b* with which the delivery medium is pumped from inlet 14 to outlet 16. Recesses 24*a*, 24*b*, 24*c* and 24*d* are all opened. In the shown position of the rotary piston, medium can flow into recesses 24*a* and 24*c* and out of recesses 24*b* and 24*d*.

Figure 2:
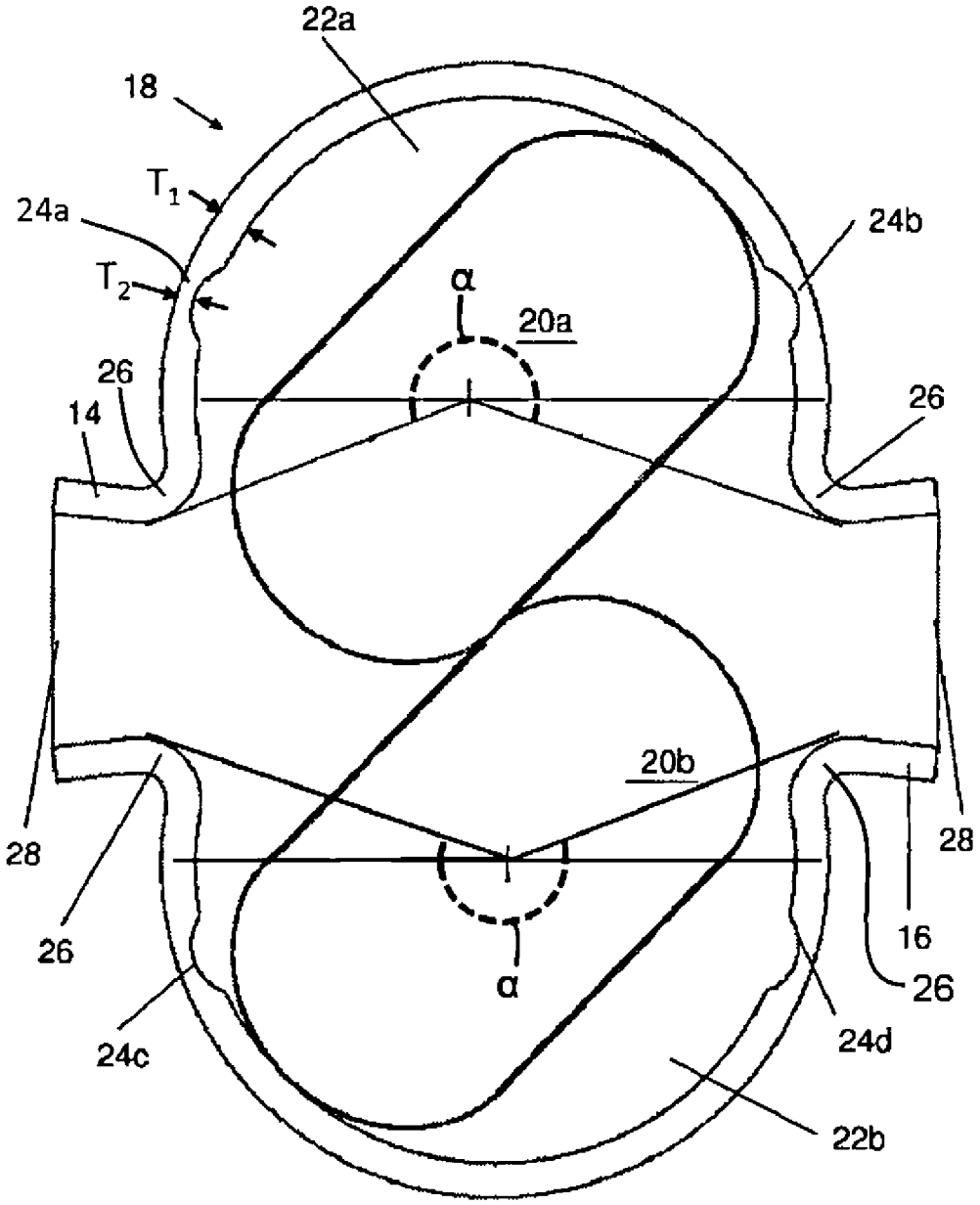
FIGS. 2 to 4 show different positions of the rotary pistons in contact with the lining of the pump housing.
Figure 3:
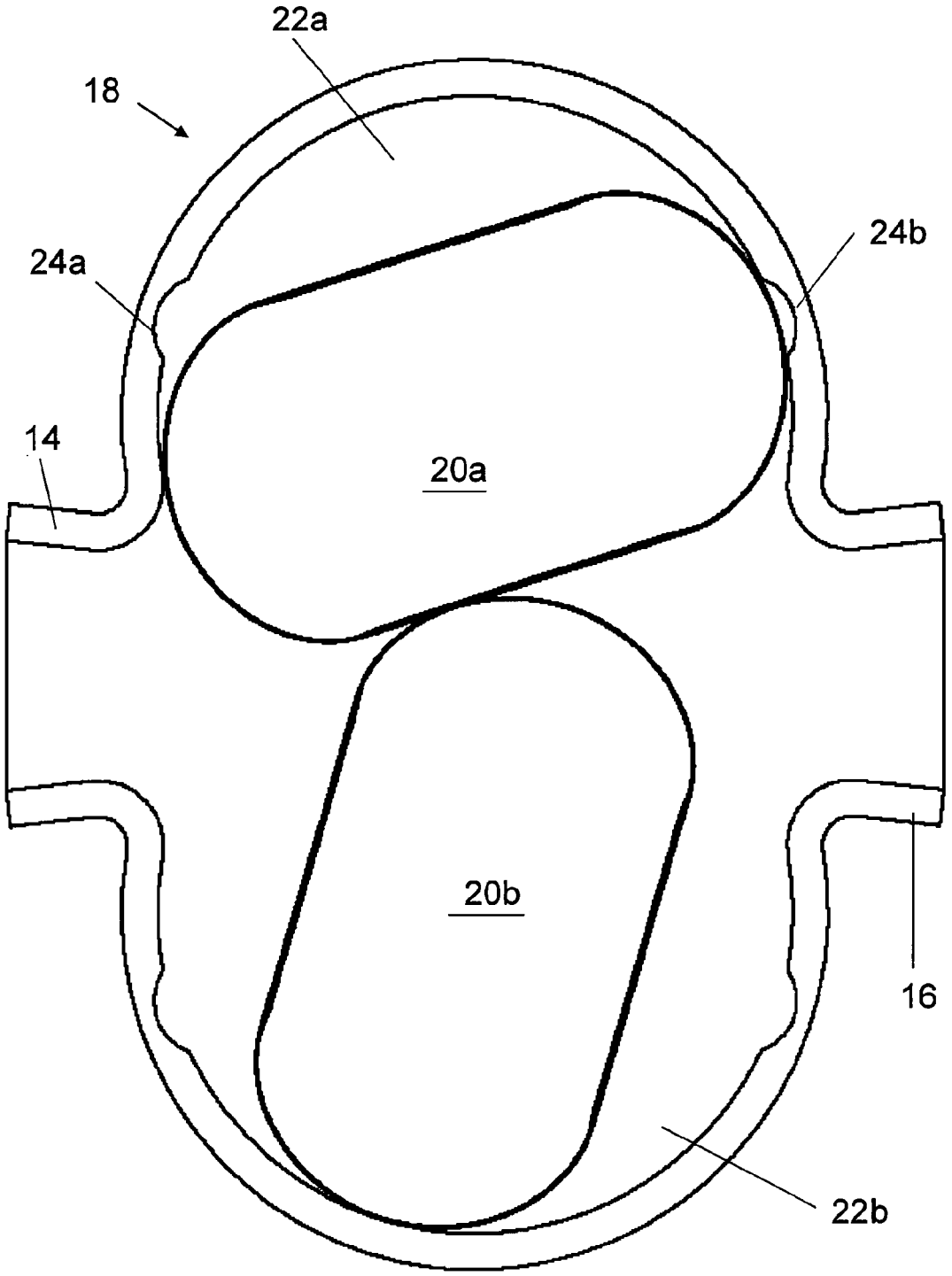
Figure 4:
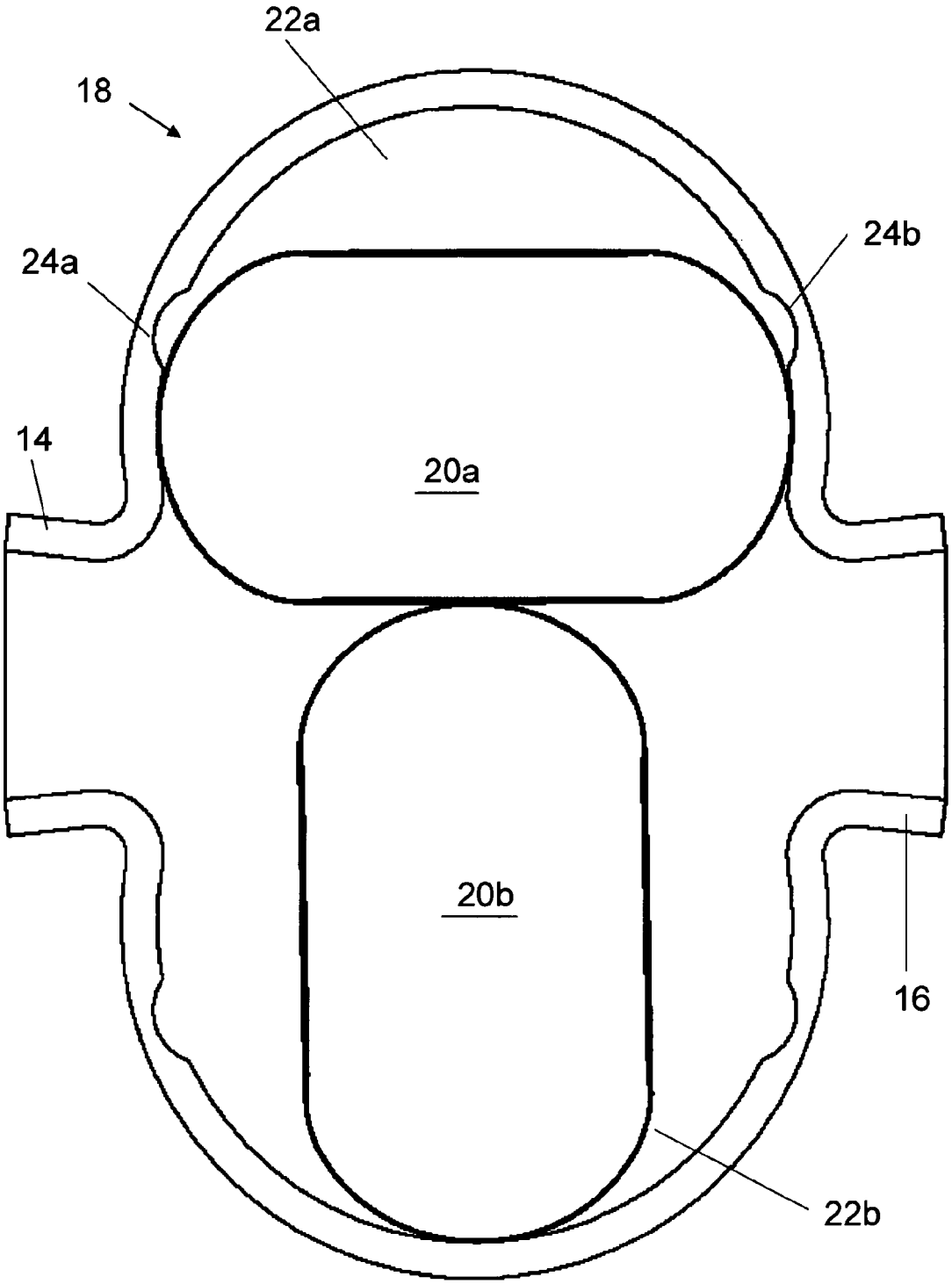

FIGS. 2 to 4 show different positions of rotary pistons 20*a* and 20*b* in contact with lining 18 of the pump housing (not represented). FIG. 2 shows a position in which rotary pistons 20*a* and 20*b* are disposed parallel to one another. Pump spaces 22*a* and 22*b* are opened. Pump space 22*a* is opened towards inlet 14, so that medium can flow into the rotary piston pump. Pump space 22*b* is opened towards outlet 16, so that medium can flow out of the rotary piston pump. Reinforcements 26 define a wrap angle $\alpha$ therebetween the wrap angle $\alpha$ being more than 180 degrees, as shown for example in FIG. 2. As a result of this angle w, an improved inflow and outflow of the medium into and out of the rotary piston pump is enabled. As a result of reinforcements 26, the cross-section of inlet 14 and outlet 16 is reduced. Inlet 14 and outlet 16 widen towards their ends 28. As a result of this widening, an improved supply of medium into the rotary piston pump and improved pumping away of the medium out of the rotary piston pump is enabled.

FIG. 3 shows a second position of rotary pistons 20*a* and 20*b* in lining 18 of the pump housing (not represented). For reasons of simplicity, only the upper region of the rotary piston pump in which pump space 22*a* is located is dealt with in the description of the figure. The processes and run-ups are to be regarded and viewed as being analogous for the region of pump space 22*b*. Pump space 22*a* is closed towards inlet 14 and towards outlet 16 by rotary piston 20*a*. Recess 24*a* is opened and can receive medium. Recess 24*b* is closed by rotary piston 20*a*. When recess 24*b* is closed with rotary piston 20*a*, the medium has been conveyed out of recess 24*a* in the direction of outlet 16.

FIG. 4 shows a third position of rotary pistons 20*a* and 20*b* in contact with lining 18 of the pump housing (not represented). Rotary piston 20*a* stands horizontally on rotary piston 20*b* disposed vertically. In this position of rotary pistons 20*a* and 20*b*, pump space 22*a* is closed with respect to inlet 14 and outlet 16. The two recesses 24*a* and 24*b* are opened towards pump space 22*a*. When recess 24*b* is opened towards pump space 22*a*, medium can flow from recess 24*b* into pump space 22*a*. The pressure in pump space 22*a* is thus increased. When the subsequent complete opening of pump space 22*a* to outlet 16 takes place, the pressure equalisation flow is much smaller, since the differential pressure between pump space 22*a* and outlet 16 has already been considerably reduced.

Figure 5:
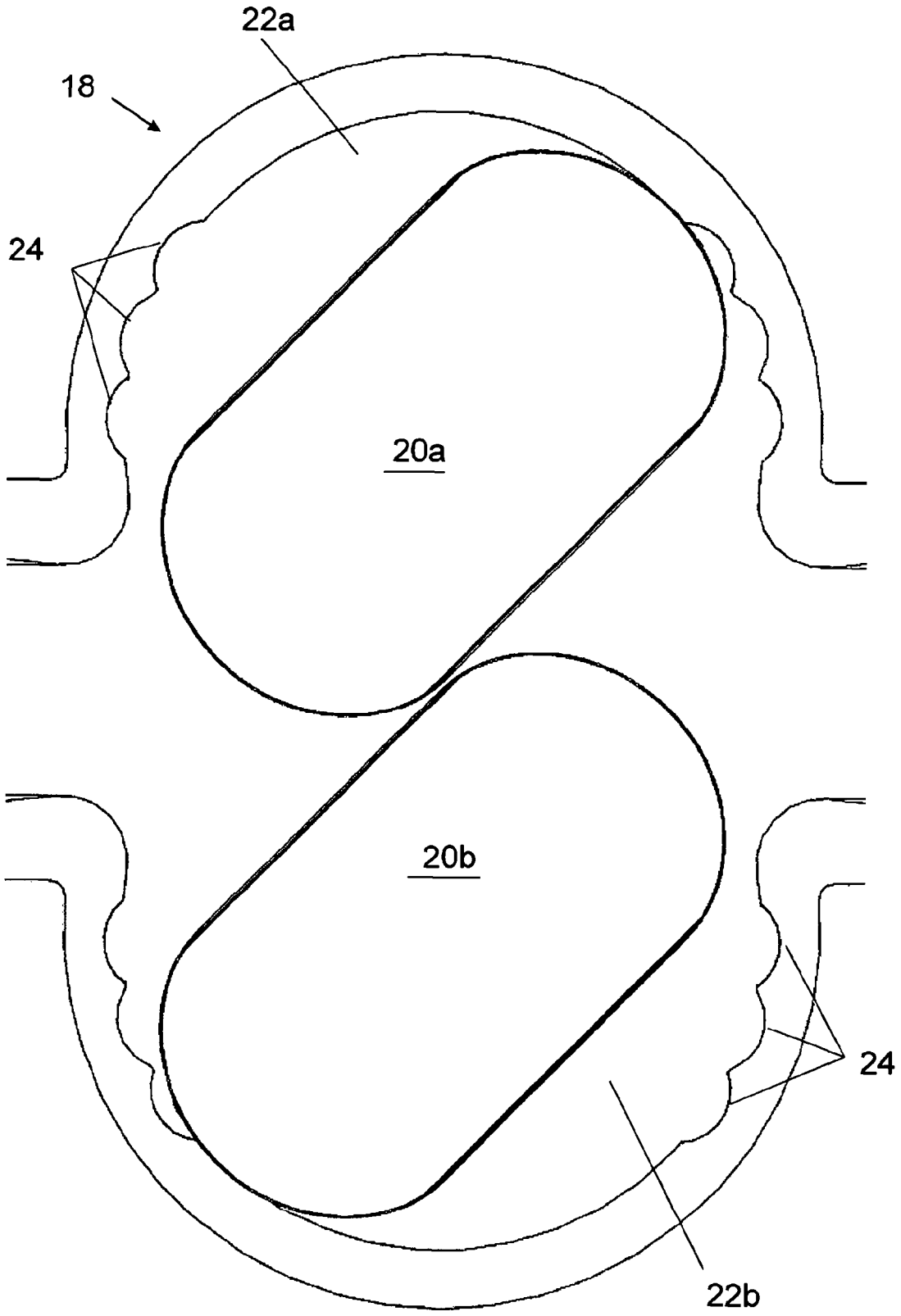
FIG. 5 shows a lining for a rotary piston pump according to the invention with twelve recesses.

FIG. 5 shows a lining 18 for a rotary piston pump according to the invention with twelve recesses 24. The twelve recesses 24 are distributed over the two pump spaces 22*a* and 22*b*. Recesses 24 are disposed in four groups with three recesses 24 in each group. Through the use of additional recesses 24, it is possible step by step to increase and reduce the pressure in pump spaces 22*a* and 22*b*. The pulsation can also again be changed by this mode of procedure. Recesses 24 are opened and/or closed after one another by rotary pistons 20*a* and 20*b*, so that the respective pressure can be changed step by step.

The invention has been described by reference to a preferred embodiment.

What is claimed is:

1. A rotary piston pump, comprising:

a pump housing having an inlet, an outlet, and a lining; and at least two counter-rotating rotary pistons disposed in the pump housing, which form respective pump spaces during their rotation, wherein the at least two counter-rotating rotary pistons are sealed against one another and against the lining of the pump housing;

wherein the lining includes recesses, each disposed in a spatial vicinity of one of the respective pump spaces and in a spatial vicinity of the inlet or the outlet, the recesses having at least one of: (i) respective depths of at least ten to thirty percent of a wall thickness of the lining, and (ii) different depths relative to one another; and wherein at least one of the pump housing and the lining includes at least a first reinforcement in a region of the inlet and a second reinforcement in a region of the outlet, the first reinforcement configured such that a cross-section of the inlet widens from the first reinforcement towards an inlet end, and the second reinforcement configured such that a cross-section of the outlet widens from the second reinforcement towards an outlet end, the first and second reinforcements defining therebetween a wrap angle of more than 180 degrees.

2. The rotary piston pump of claim 1, wherein the recesses include at least four recesses disposed in each of the respective pump spaces, the recesses always being disposed in pairs.

3. The rotary piston pump of claim 1, wherein a pulsation of the rotary piston pump is prevented by opening and closing of the recesses by the at least two counter-rotating rotary pistons.

4. The rotary piston pump of claim 1, wherein an optimized flow of a delivery medium is achieved as a result of the widening, and a pulsation is reduced by the optimized flow, in combination with the recesses.

5. The rotary piston pump of claim 1, wherein respective distances of the recesses from the inlet or from the outlet amount to between two and five times respective cross-sectional dimensions of the recesses.

6. The rotary piston pump of claim 1, wherein the recesses have different cross-sections.

7. The rotary piston pump of claim 1, further comprising respective spacings between each of the recesses.

8. A method of delivery of a media using a rotary piston pump, the media being least one of fluids and fluids containing solids, the method comprising the steps of:

introducing the media to an inlet region of a pump housing of a rotary piston pump;

counter-rotating two rotary pistons disposed in the pump housing or inside a lining of the pump housing, sealed against one another, against the pump housing, and against the lining, the two rotary pistons forming respective pump spaces during their rotations;

pumping the media past a first reinforcement of at least one of the pump housing and the lining in a vicinity of the inlet region, which reduces a cross-section of the inlet region, and into a pump space;

pumping the media through the pump space and across at least two recesses disposed in the pump space, the at least two recesses at least one (i) have respective depths of at least ten to thirty percent of a wall thickness of the lining; and (ii) have different depths; and pumping the media past a second reinforcement of at least one of the pump housing and the lining in a vicinity of an outlet region, which reduces a cross-section of the outlet region, and out of the pump space;

wherein the respective cross-sections of the inlet and outlet widen from the first and second reinforcements towards respective ends of the inlet and outlet, and the first and second reinforcements define therebetween a wrap angle of more than 180 degrees.

9. The method of claim 8, wherein the step of pumping the media across at least two recesses further includes moving the media across four recesses, the recesses always being disposed in pairs.

10. The method of claim 8, further comprising the step of preventing a pulsation of the rotary piston pump by opening and closing the at least two recesses by the two rotary pistons.

11. The method of claim 8, further comprising the step of optimizing flow of the media through the rotary piston pump as a result of the widening, and reducing a pulsation using the optimized flow in combination with the at least two recesses.

12. The method of claim 8, wherein the step of pumping the media through the pump space further includes pumping the media between two and five times respective cross-sectional dimensions of the at least two recesses before the media reaches a first recess from the inlet and before the media reaches the outlet from a last recess.

13. The method of claim 8, wherein the step of pumping the media across at least two recesses further includes pumping the media across at least two recesses of different cross-sections.

14. The method of claim 8, wherein the step of pumping the media through the pump space further includes pumping the media through a space between the at least two recesses.

* * * * *